US008640503B2

(12) United States Patent
Kunde et al.

(10) Patent No.: US 8,640,503 B2
(45) Date of Patent: Feb. 4, 2014

(54) KNITWEAR WITH A PERFORATED STRUCTURE AND METHOD FOR PRODUCING SAID KNITWEAR

(75) Inventors: Klaus Kunde, Chemnitz (DE); Franz Hudi, Nuertingen (DE); Andrea Rudolph, Chemnitz (DE)

(73) Assignee: Terrot GmbH, Chemnitz (DE)

( * ) Notice: Subject to any disclaimer, the term of this patent is extended or adjusted under 35 U.S.C. 154(b) by 0 days.

(21) Appl. No.: 13/698,114

(22) PCT Filed: Jan. 19, 2012

(86) PCT No.: PCT/IB2012/050261
§ 371 (c)(1),
(2), (4) Date: Nov. 15, 2012

(87) PCT Pub. No.: WO2012/101553
PCT Pub. Date: Aug. 2, 2012

(65) Prior Publication Data

US 2013/0152640 A1 Jun. 20, 2013

(30) Foreign Application Priority Data

Jan. 28, 2011 (DE) ..... 10 2011 000 398

(51) Int. Cl.
*D04B 9/06* (2006.01)

(52) U.S. Cl.
USPC ..... 66/25

(58) Field of Classification Search
USPC ..... 66/25, 17, 148, 8, 13, 19, 147
See application file for complete search history.

(56) References Cited

U.S. PATENT DOCUMENTS

| | | | |
|---|---|---|---|
| 2,024,326 | A | 12/1935 | Allerton et al. |
| 2,657,561 | A | 11/1953 | Saunders et al. |
| 5,887,451 | A | 3/1999 | Suzuki |
| 6,199,409 | B1 | 3/2001 | Shibata |
| 7,536,879 | B2 | 5/2009 | Vanwelden |

FOREIGN PATENT DOCUMENTS

| | | |
|---|---|---|
| DE | 157 418 | 7/1902 |
| DE | 646 278 | 6/1937 |
| DE | 947 823 | 8/1956 |
| DE | 697 12 995 T2 | 1/2003 |
| EP | 1 070 776 A2 | 1/2001 |
| EP | 1 975 294 A1 | 10/2008 |

OTHER PUBLICATIONS

Schlotterer, Helmut: "Pitt Filati überraschte mit neuer 3D-CMS-Strickkollektion", Wirkerei- und Strickerei-Technik 40 (1990), pp. 1160-1162.

Greuter Jersey AG: Production of Superfine Stitch Fabrics, Milan, Textile Reports.

*Primary Examiner* — Danny Worrell
(74) *Attorney, Agent, or Firm* — Laurence A. Greenberg; Werner H. Stemer; Ralph E. Locher

(57) ABSTRACT

A method for producing knitwear formed at least partially as single jersey knitwear with a perforated structure and a functional textile based on the knitwear, provide very fine knitting stitches and perforated structures with large holes meeting demands of sportswear and underwear. The knitwear is produced on a double jersey knitting machine with first and second oppositely disposed needle carriers and a machine gauge of >24 needles/inch. The first needle carrier has a needle number/inch of latch-type needles corresponding to the machine gauge and the second needle carrier has transfer needles. The needle number/inch of the transfer needles is at most half that of the latch-type needles of the first needle carrier. The transfer needles form loop accumulations with at least one tuck loop per hole subsequently transferred with or without at least one knitting stitch from the transfer needles onto the latch-type needles.

15 Claims, 5 Drawing Sheets

KNITWEAR WITH A PERFORATED STRUCTURE AND METHOD FOR PRODUCING SAID KNITWEAR

BACKGROUND OF THE INVENTION

Field of the Invention

The present invention relates to a method for producing a knitwear designed at least partially as single jersey knitwear with a perforated structure and to a functional textile which is based on a knitwear designed at least partially as a single jersey knitwear with a perforated structure.

Particularly in the sector of sports articles, there has been increasing interest in recent years in being able to make available sports clothing which has high elasticity and also possesses good wearing properties and air permeability which is adapted to the respective types of sport and which is preferably also to a different degree in different regions of the clothing. Thus, for example, it will be desirable to produce sports T-shirts which have a perforated structure under the wearer's armpits and which are of especially fine form in the wearer's stomach and back parts. At the same time, it is considered to be especially advantageous if as large holes as possible and/or holes with different sizes can be formed, in addition to very fine regions of the textile, in one and the same sports clothing.

Structures of this kind can be produced, for example, in the form of warp-knitted fabric in which stable holes can be made available in textile sheet-like structures. However, because of low elasticity, warp-knitted fabric is used to only a limited extent for the production of clothing. Substantially better elasticity can be achieved in the production of knitwear. Thus, for example, in the case of circular knitwear, there is natural elasticity in the longitudinal and the transverse direction, this being ideal for the production of clothing textiles, particularly in the sports article or laundry sector.

The hitherto customary technique for forming holes on circular knitting machines employs fine PA (polyamide) and/or PES (polyester staple fiber) yarns or monofilaments or adopts the cast-off technique with subsequent latch opening. However, the cast-off of stitches entails the risk that runs will occur under high tensile stress, such as often happens, for example, in sport. Knitwear produced in this way therefore has restricted use particularly in the sports article sector.

Furthermore, there is the possibility of producing in a double jersey knitwear perforations which are knitted in on a double jersey transfer circular knitting machine and are therefore run-proof. This technique is also known as fine rib transfer. Such knits can be produced, for example, as circular-knitted fabrics on what are known as transfer machines, in which the cylindrical stitches are selected by means of electronic needle selection and are transferred to the needles of the rib dial. Hole-like orifices occur at these transfer points on the fabric outside, that is to say the cylindrical needle side, and give the fabric the characteristic appearance of eyelet fabric. These double-faced knits are usually produced by what is known as the RR technique. That is to say, they have two fabric sides which are connected to one another and have "right" stitches. The production of these transfer fabrics is greatly restricted because of the machine technique which has an adverse effect by limiting the machine fineness, high fabric weights and low fabric production capacity. According to the prior art, needles with an attached transfer spring are used for this purpose and "widen" the stitches to be transferred in order to provide the necessary free space for the needles to be taken over. Needles with a transfer spring have a structurally brought-about space requirement which restricts the production of high machine finenesses, for example finer than E18 and E20. Moreover, circular knitting machines currently available commercially are equipped with only a few knitting or transfer systems, thus greatly restricting the production capacity.

The publication EP 1 070 776 A2 discloses a double jersey circular knitting machine for the production of thin, lightweight and yet high-density textiles. This circular knitting machine possesses a rotatable cylinder with a multiplicity of vertically oriented conventionally designed knitting needles. The conventionally designed knitting needles have no transfer function and are mounted vertically movably in corresponding grooves in the cylinder. Furthermore, the known circular knitting machine has a rotatable rib dial with a multiplicity of horizontal radially oriented grooves. Horizontally movable rib needles are accommodated in the grooves. The rib needles are designed as transfer needles. The known circular knitting machine has the particular feature that twice as many needles are provided in the cylinder as there are transfer needles on the rib dial. As a result, despite the space requirement of the transfer needles and the therefore small number of needles on the rib dial, it is possible to produce especially fine knits because of the large number of needles on the cylinder of the known circular knitting machine. It is true that the most diverse possible knitting patterns for implementation on the circular knitting machine presented can be found in publication EP 1 070 776 A2. However, these patterns have no perforated structures.

BRIEF SUMMARY OF THE INVENTION

The object of the present invention is to make available a knitting method which makes it possible to produce a knitwear which has, on the one hand, very fine stitches and, on the other hand, perforated structures with relatively large holes, so that this knitwear fulfils, for example, the requirements of textiles in the sports article or laundry sector. Furthermore, according to the present invention, a corresponding functional textile is to be provided.

The object is achieved, on the one hand, by means of a method for producing a knitwear designed at least partially as single jersey knitwear with a perforated structure, the knitwear being produced on a double jersey knitting machine with a first and a second needle carrier and with a machine fineness of ≥24 needles/inch, the first needle carrier being arranged opposite the second needle carrier, the first needle carrier having a needle number/inch of latch needles corresponding to the machine fineness, and the second needle carrier having transfer needles, the needle number/inch of the transfer needles being smaller at least by the factor 2 than the needle number/inch of the latch needles of the first needle carrier, and loop accumulations with at least one tuck loop per hole being formed by means of the transfer needles and the tuck loops subsequently being transferred from the transfer needles onto the latch needles without or with at least one stitch.

As stated above, in the prior art there is a contradiction between the possibility of forming dense knits as fine as possible, on the one hand, and the possibility of forming as large holes as possible in the knit, on the other hand. The opinion hitherto has been that, when it is desirable to generate as large holes as possible in a knit, as thick needles as possible have to be used or the risk of runs being formed must be taken into account. By contrast, in the prior art, it is necessary to use as thin needles as possible when it is desirable to generate fine dense knits.

By means of the method according to the invention, it is possible to implement the previously incompatible requirements of knitwear, such as fineness and large holes, on one and the same knitting machine in a continuous knitting method. Thus, the fineness of the knitwear can be achieved by means of the large number of latch needles of the first needle carrier. By contrast, the holes are generated, using the loop accumulations with at least one, preferably with at least two tuck loops per hole, which are subsequently transferred from the transfer needles to the latch needles without or with at least one stitch.

The size of the holes to be formed can be defined by the number of tuck loops per loop accumulation. Furthermore, according to the invention, a single jersey knitwear which has at least partially a perforated structure can be produced on a double jersey knitting machine. The perforated structure can be provided on correspondingly suitable locations in the knitwear, so that it is possible, for example, to form relatively large holes in those regions of the knitwear in which the subsequent wearer of the knitwear is especially inclined to perspire, whereas a fine dense structure is formed in other regions in which thermal protection of the subsequent wearer of the knitwear is required. In this case, the perforated structures formed in the knitwear may be formed on different regions of the knitwear with a different size and structure.

Since a knitwear is produced by means of the method according to the invention, it can be made available with high elasticity both in its longitudinal and in its transverse direction. The method according to the invention is correspondingly suitable particularly for the production of clothing textiles in the sports article or laundry sector. However, even markedly more possibilities of use are afforded, thus the method according to the invention may also be used, for example, for producing other functional textiles, such as, for example, covering or mattress materials.

In a preferred variant of the present invention, the transfer needles are transfer needles corresponding to a needle carrier fineness of ≥18 needles per inch. Thus, according to the invention, especially fine and dense knits with comparatively large holes can be formed.

In a preferred embodiment of the present invention, the double jersey knitting machine used is a double jersey circular knitting machine. In this case, for example, the latch needles may be provided on the rib dial and the transfer needles on the cylinder of the double jersey circular knitting machine, the latch needles on the rib dial being provided so as to have at least twice the number of needles as the transfer needles on the cylinder. It is also basically possible, however, to provide the latch needles on the cylinder and the transfer needles on the rib dial of the double jersey circular knitting machine. The circular knitting machine is suitable particularly for the production of clothing textiles, such as T-shirts or vests, which can be provided with large holes, for example, particularly in regions in which high breathing activity is desired, whereas the stomach and back regions of T-shirts or vests can be formed as a dense fine knit. However, the method according to the invention may also basically be applied to flat bed knitting machines.

It is especially advantageous if the cylinder needles used are transfer needles which are selected by means of a mechanical or electronic selection device. It is especially preferable, according to the invention, to use an electronic Jacquard device for individual needle selection. A highly efficient automated knitting method can thereby be made available, by means of which the most diverse possible knitting patterns of the knitwear to be formed can be produced.

According to a beneficial embodiment of the method according to the invention, knops projecting out of a face of the knitwear are formed, using the loop accumulations. Such knops may be provided, for example, on clothing textiles and serve in these as spacers between the textile and the body of a wearer of the clothing textile. The larger the number of tuck loops per loop accumulation, the greater can be the respective knops which are formed.

In specific applications of the present invention, at least one weft thread can be worked into the knitwear. Thus, for example, textiles with increased stability and with an enlarged volume can be formed. Knits with a weft insert can therefore be produced, for example, as composite materials for mattresses.

In an advantageous exemplary embodiment of the present invention, the sizes and/or spacings of the holes of the perforated structure and/or of the knops are formed as a function of the requirements of the knitwear with regard to its capacity for the exchange of gas, heat and/or water vapor and/or with regard to its elasticity. If, for example, an increased exchange of air is to be made possible at specific locations in the knitwear, it is recommended to provide as large hole sizes as possible and/or as small hole spacings as possible in the perforated structure. As large hole sizes as possible and/or as small hole spacings as possible of the perforated structure likewise afford increased elasticity of the knitwear. Furthermore, the knop size is also influenced directly by the hole size, so that, when large holes are formed, large knops are obtained which, in turn, can provide a large spacing from, for example, the body of a wearer of a clothing textile.

It is also advantageous if the double jersey knitting machine knits by means of at least two systems with a following transfer system. Work can thereby be carried out especially effectively so that a large quantity of knitwear can be produced in a short time.

In specific variants of the present invention, it is also possible to design the needle number/inch of the transfer needles to be smaller by the factor 3 or 4 than the needle number/inch of the latch needles of the first needle carrier. An especially large number of latch needles can thereby be used, and consequently a high fineness of the knitwear to be formed can be achieved. The larger the number of latch needles of the first needle carrier, the finer and denser the knits which can be produced.

The object of the present invention is achieved, furthermore, by means of a functional textile based on a knitwear designed at least partially as single jersey knitwear with a perforated structure, the knitwear being obtainable by knitting, using a double jersey knitwear with a first and a second needle carrier and with a machine fineness of ≥24 needles/inch, the first needle carrier being arranged opposite the second needle carrier, the first needle carrier having a needle number/inch of latch needles corresponding to the machine fineness and the second needle carrier having transfer needles, the needle number/inch of the transfer needles being smaller by at least the factor 2 than the needle number/inch of the latch needles of the first needle carrier, and the perforated structure being formed from loop accumulations generated by means of the transfer needles and having at least one, preferably at least two tuck loops per hole, which are transferred from the transfer needles onto the latch needles without or with at least one stitch.

The functional textile according to the invention may be, for example, a clothing textile capable of being used in the sports or laundry section. Basically, however, the functional textile according to the invention can be used variably. Thus, according to the invention, a functional textile is to be understood as meaning a textile which is constructed according to physiological standpoints and, in particular, is to cause moisture to be transported away. The functional textile may be configured, for example, such that neither water nor wind can penetrate through the functional textile from outside, but such that the functional textile enables water vapor, such as perspiration, to escape by permeation from the inside outward. That is to say, the functional textile according to the invention makes it possible to have an exchange of gas, heat and/or water vapor.

Since the functional textile according to the invention is knitwear, it has the advantageous bi-elasticity properties associated with knitwear. Furthermore, it can be made available with very high fineness and density because of the large number of latch needles in the first needle carrier. In spite of the fine and dense form of the knitwear, the holes of the perforated structure introduced into the functional textile according to the invention can be formed variably and also be made large, as compared with previous possibilities. The hole size is in this case determined by the number of tuck loops per hole. Relatively large elongate holes are typically obtained in this case. Moreover, it is also possible to provide holes of different size and/or with different hole spacings in different regions of the functional textile, so that the functional textile can be adapted ideally to the desired intended use.

Preferably, the functional textile according to the invention is configured such that the perforated structure is provided for locally increasing the vapor permeability of the functional textile. Thus, for example on T-shirts, the perforated structures may be provided advantageously under the armpits.

It is especially beneficial if the perforated structure is provided at least on a right fabric side of the functional textile and knops formed, using the loop accumulations, and projecting out of a face of the knitwear are provided on a left fabric side of the functional textile. These knops may serve, for example when used in a clothing textile, as a spacer from the body of the respective wearer of the clothing textile.

In specific applications of the functional textile according to the invention, it may be advantageous if at least one weft thread is worked into the knitwear. Both the stability and the volume of the knitwear can thereby be increased.

According to an especially preferred embodiment of the functional textile according to the invention, the sizes and/or spacings of the holes of the perforated structure and/or of the knops are formed as a function of local requirements of the functional textile with regard to its capacity for the exchange of gas, heat and/or water vapor and/or with regard to its elasticity. The functional textile according to the invention can therefore be produced so as to be geared exactly to its intended use. In this case, the functional textile according to the invention can combine several different properties in terms of the capacity of the exchange of gas, heat and/or water vapor and/or in terms of the elasticity of the functional textile and at the same time can nevertheless be produced on a single knitting machine in a single knitting process. The functional textile according to the invention can consequently be produced with high functionality and yet with very high effectiveness and therefore cost-effectively.

BRIEF DESCRIPTION OF THE SEVERAL VIEWS OF THE DRAWING

Preferred embodiments of the present invention, and their construction, function and advantages are explained in more detail below by means of figures, in which.

DESCRIPTION OF THE INVENTION

Figure 1:
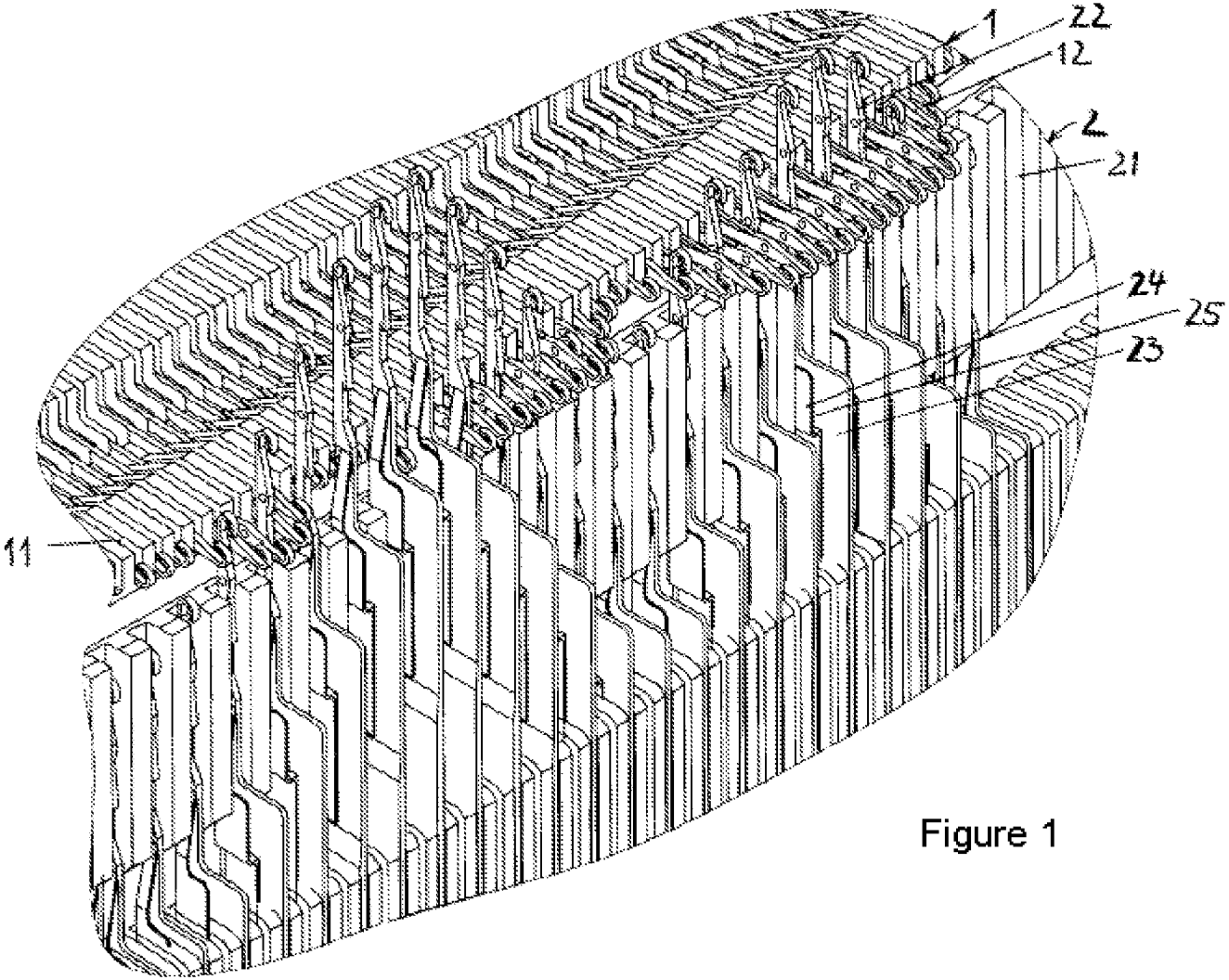
FIG. 1 shows diagrammatically a perspective view of a detail of a rib dial and a cylinder of a circular knitting machine, which is suitable for carrying out the method according to the invention and for producing the functional textile according to the invention.

FIG. 1 shows diagrammatically a perspective illustration of a detail of a circular knitting machine capable of being used for carrying out the method according to the invention. The circular knitting machine shown is a double jersey knitting machine with a first needle carrier 1 in the form of a rotating rib dial and with a second needle carrier 2 in the form of a rotating cylinder. The first needle carrier 1 is arranged opposite the second needle carrier 2. In this case, the needles which are arranged on the first needle carrier 1 and the second needle carrier 2 of the circular knitting machine illustrated in FIG. 1 are oriented at an angle of 90° to one another.

Horizontal grooves 11, in which conventionally designed latch needles 12 are individually guided so as to be horizontally movable, are formed on the rib dial used as the first needle carrier 1. The latch needles 12 are provided so as to have a needle number/inch corresponding to the machine fineness of the circular knitting machine used. In the method according to the invention, this machine fineness is at least E24 and is advantageously E28. A large number of fine latch needles 12 are correspondingly arranged relatively closely next to one another on the first needle carrier 1.

The second needle carrier 2, provided in the form of a cylinder in the exemplary embodiment of FIG. 1, has circularly arranged vertically formed grooves 21 in which transfer needles 22 are individually movable vertically. The transfer needles 22 can perform a transfer function in that a spring 24 is provided on the needle shank 23 of the transfer needles, thus forming between the cylinder needle shank 23 and the spring 24 an interspaced 25 into which the needle head 13 of a latch needle 12 of the first needle carrier 1 can penetrate. By virtue of this construction, fewer transfer needles 22 can be provided on the second needle carrier 2 than latch needles 12 on the first needle carrier 1. Thus, the selected needle number/inch of the transfer needles 22 in the exemplary embodiment illustrated in FIG. 1 is, for example, smaller by the factor 2 than the needle number/inch of the latch needles 12 of the first needle carrier 1.

In other embodiments of the present invention which are not shown, the needle number/inch of the transfer needles 22 may be even smaller. For example, it may be smaller by the factor 3 or 4 than the needle number/inch of the latch needles 12 of the first needle carrier 1.

That is to say, in the circular knitting machine illustrated in FIG. 1, the rib dial contains latch needles 1 and the needle cylinder transfer needles 22 which move in two mutually independent needle beds of different fineness and bring about a transfer of stitches from the rib dial onto the cylinder and from the cylinder onto the rib dial.

In the exemplary embodiment illustrated in FIG. 1, very fine transfer needles 22 of E18 (press 0.48) are used in the second needle carrier 2. In this case, the cylinder used as the second needle carrier 2 has a special division corresponding to half the needle number/inch of the first needle carrier 1, that is to say, for example, E12 or E14. The needle spacing obtain on the second needle carrier 2 as a result of the higher division value is in this case designed such that the needles of the first needle carrier 1 and of the second needle carrier 2 which lie in each case opposite one another can knit completely contactlessly.

Furthermore, systems which are fitted with latch openers are provided on the cylinder between the transfer systems. The object of the latch openers is to open the needle latch of the transfer needles 22 so that a new thread can be introduced into the needle hook of the respective transfer needle 22.

Figure 5:
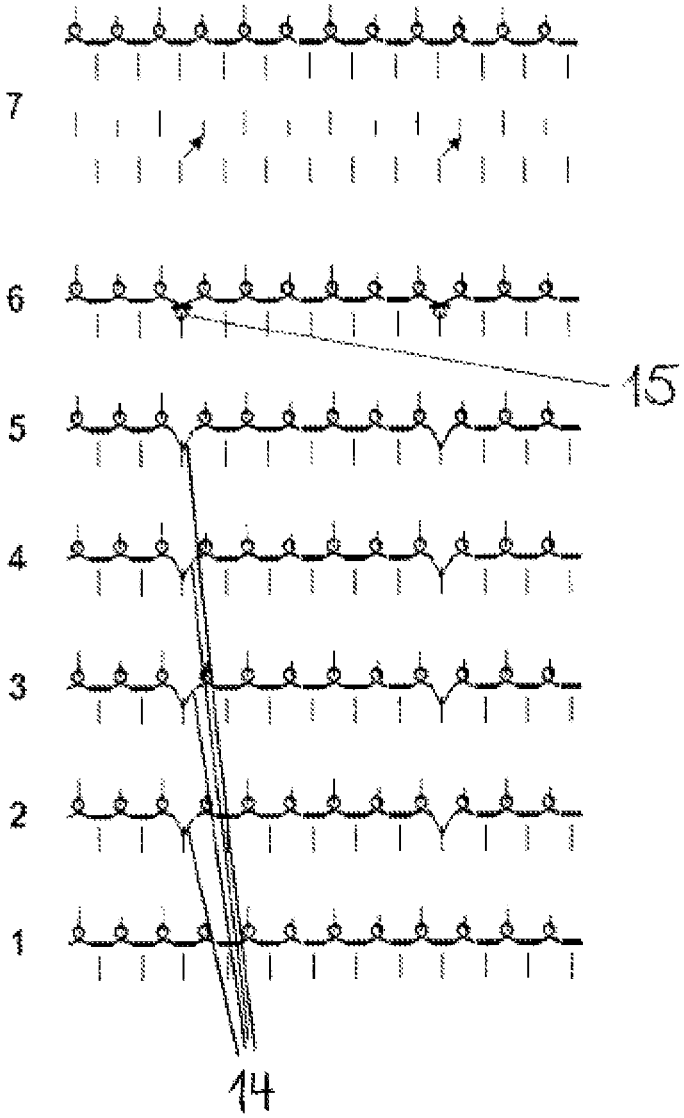
FIG. 5 shows diagrammatically an exemplary embodiment of a repeat of knitwear capable of being produced with the aid of the method according to the invention.
Figure 6:
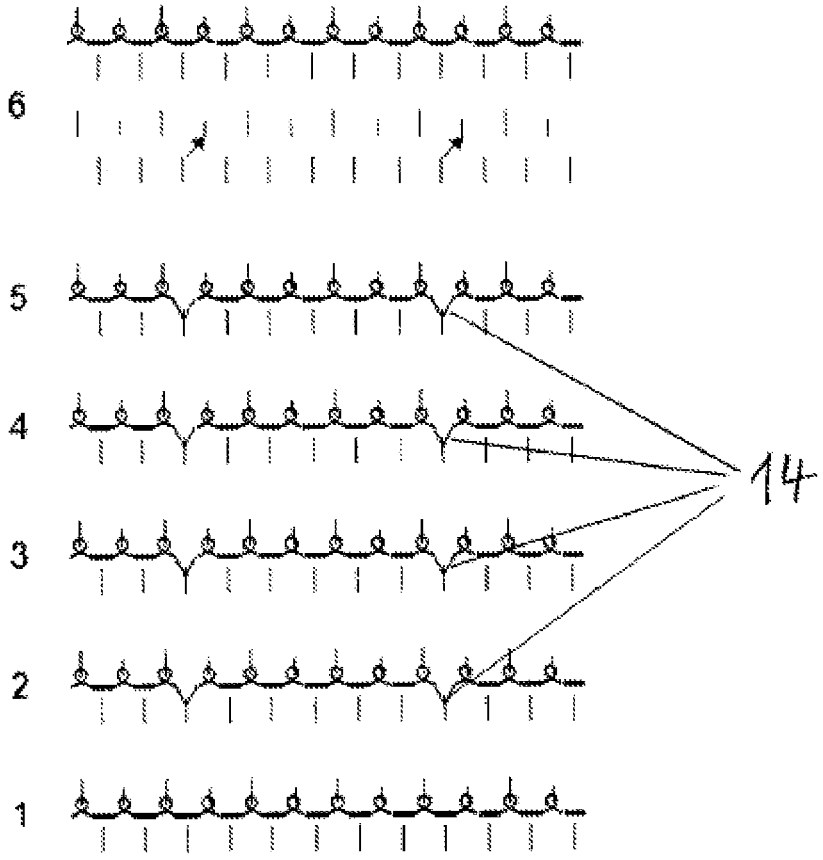
FIG. 6 shows diagrammatically a further possible exemplary embodiment of a repeat of knitwear capable of being produced with the aid of the method according to the invention.

In the circular knitting machine illustrated in FIG. 1, an electronic Jacquard device is provided for individual needle selection. In other embodiments of the present invention which are not shown, manual needle selection may also be carried out. The circular knitting machine shown operates as follows:

To form perforated structures, the transfer needles 22 on the cylinder which are selected via the electronic Jacquard device pick up the thread in a recurring double, triple or quadruple tuck position. The tuck loops 14 generated in this way on a transfer needle 22 and shown, for example, in the stitch rows 2 to 5 of FIGS. 5 and 6 are taken over in the following transfer system, as shown by corresponding arrows in rows 7 and 6 of FIGS. 5 and 6, by the latch needles 12 on the rib dial. In combination with the latch needles 12 in the RL expulsion position which operate on the rib dial in each system, a single jersey knit is obtained on the rib dial and is characterized, as a function of the number of tuck loops 14 generated in each case, by eyelet orifices which can be set at different sizes and can be selected freely according to the pattern.

Owing to the large needle number/inch of the latch needles 12 on the first needle carrier 1, a very fine knit is generated which can implement the fabric character of a, for example, E24 transfer fabric. In spite of the fine stitches, the above-described technique may be utilized at the same time to form relatively large holes in the knitwear which, however, are also of different size.

When the holes are being formed, knops are formed in each case in the other fabric side of the knitwear and may be utilized, for example, as spacers from the body of a wearer of a textile produced from the knitwear.

Figure 2:
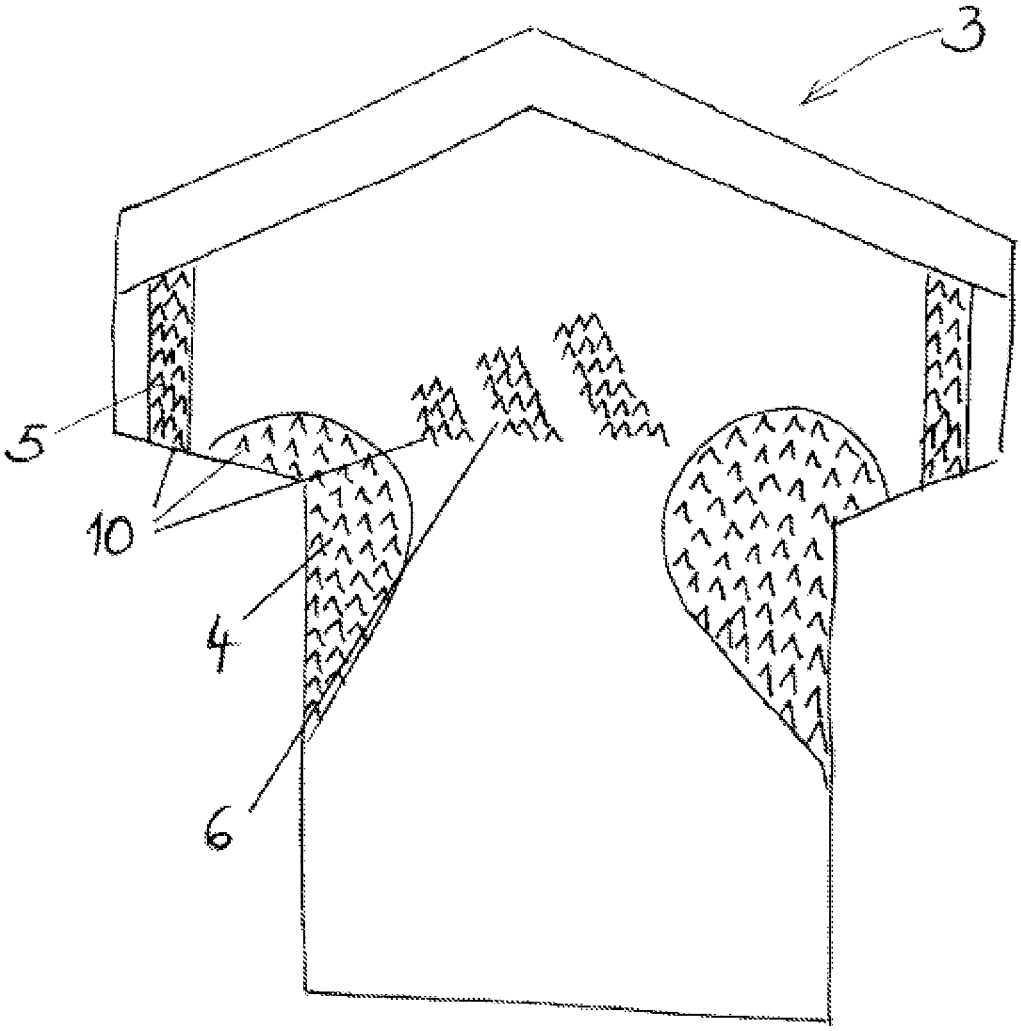
FIG. 2 shows diagrammatically an example of a functional textile according to the invention.

One example of a functional textile produced with the aid of the method according to the invention is illustrated in FIG. 2.

FIG. 2 shows diagrammatically one possible design of a T-shirt which can be produced in one process on one and the same knitting machine with the aid of the method according to the invention. The functional textile 3 shown has holes 10 of different size at different locations. Thus, for example, very large holes 10 are formed at the locations 4 which are situated under the armpits of a subsequent wearer of the T-shirt, whereas smaller and denser perforated structures are provided at other locations 5 or 6 of the functional textile 3 and, in the example shown, possess a merely decorative function. The large holes 10 in the regions 4 give rise at these locations to especially high breathing activity of the functional textile 3 shown by way of example. Especially good air exchange between the wearer of the functional textile 3 and the surroundings is possible at these locations. The functional textile 3 correspondingly has very high functionality, while at the same time having high elasticity. Since the functional textile 3 could be produced in a single process on one knitting machine, such as the knitting machine shown in FIG. 1, it can also be produced with high effectiveness and therefore with low costs.

Figure 3:
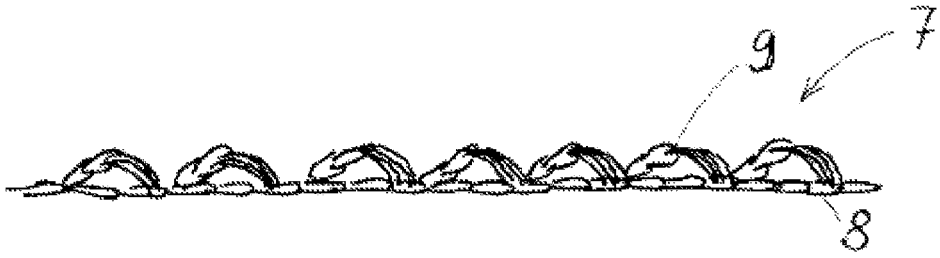
FIG. 3 shows diagrammatically an example of knitwear produced by the method according to the invention and having knops, in a cross-sectional illustration.

FIG. 3 shows diagrammatically a cross-sectional illustration of an example of a knitwear 7 which is produced with the aid of the method according to the invention and in which knops 9 are formed on a basic fabric 8. The knops 9 arise in that holes 10 are formed in each case on the other fabric side as a result of the formation of tuck loop accumulations, as shown in FIG. 4.

Figure 4:
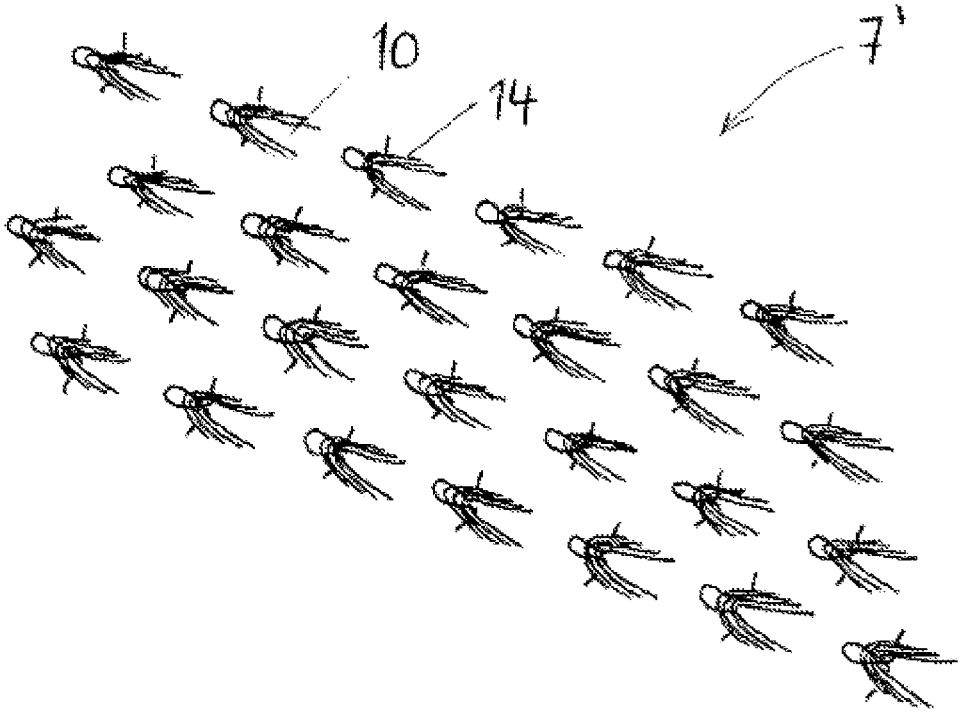
FIG. 4 shows diagrammatically an example of knitwear produced by the method according to the invention and having holes, in a top view of a fabric side of the knitwear.

FIG. 4 shows diagrammatically a top view of knitwear 7' capable of being produced with the aid of the method according to the invention and having holes 10 which are formed by the tuck loop accumulations 14 in the knitwear 7' which are constructed by knitting.

FIG. 5 shows diagrammatically an exemplary embodiment of a thread profile of knitwear capable of being produced with the aid of the method according to the invention. In the example illustrated, tuck loops 14 are generated in a cylinder, in each case at the same location, in the stitch rows 2 to 5 and are subsequently knitted in the stitch row 6 by means of a stitch 15, the tuck loop accumulation subsequently being transferred by means of the stitch 15 from the cylinder onto the rib dial, as indicated in row 7 by the arrows.

FIG. 6 shows another possible variant of a thread profile of knitwear capable of being produced with the aid of the method according to the invention. In this variant, tuck loops 14 are likewise generated in the cylinder, in each case in the same wale position, for example in the stitch rows 2 to 5, and are subsequently transferred without a stitch from the cylinder onto the rib dial, as indicated diagrammatically in row 6 by the arrows.

The invention claimed is:

1. A method for producing a knitwear formed at least partially as single jersey knitwear with a perforated structure having holes, the method comprising the following steps:

producing the knitwear on a double jersey knitting machine with first and second needle carriers and a machine fineness of ≥24 needles/inch;

placing the first needle carrier opposite the second needle carrier;

providing the first needle carrier with a needle number/inch of latch needles corresponding to the machine fineness;

providing the second needle carrier with transfer needles having a needle number/inch being smaller at least by a factor of 2 than the needle number/inch of the latch needles of the first needle carrier;

forming loop accumulations of at least two tuck loops per hole using the transfer needles; and subsequently transferring the tuck loops from the transfer needles onto the latch needles with or without at least one stitch.

2. The method according to claim 1, wherein the transfer needles are transfer needles corresponding to a needle carrier fineness of ≥18 needles/inch.

3. The method according to claim 1, wherein the double jersey knitting machine is a double jersey circular knitting machine.

4. The method according to claim 3, wherein the double jersey circular knitting machine has a rib dial on which the latch needles are provided and a cylinder on which the transfer needles are provided.

5. The method according to claim 3, wherein the transfer needles are cylinder needles selected by a mechanical or electronic selection device.

6. The method according to claim 1, which further comprises forming knops projecting out of a face of the knitwear using the loop accumulations.

7. The method according to claim 1, which further comprises working at least one weft thread into the knitwear.

8. The method according to claim 6, which further comprises forming at least one of sizes or spacings of at least one of the holes of the perforated structure or the knops as a function of requirements of the knitwear with regard to at least one of its capacity for an exchange of at least one of gas, heat or water vapor or its elasticity.

9. The method according to claim 1, which further comprises knitting with the double jersey knitting machine using at least two systems with a following transfer system.

10. The method according to claim 1, wherein the needle number/inch of the transfer needles is smaller by a factor of 3 or 4 than the needle number/inch of the latch needles of the first needle carrier.

11. A functional textile, comprising:

a knitwear constructed at least partially as a single jersey knitwear with a perforated structure having holes and being produced by knitting on a double jersey knitting machine with first and second mutually opposite needle carriers and a machine fineness of ≥24 needles/inch, the first needle carrier having a needle number/inch of latch needles corresponding to the machine fineness, the second needle carrier having transfer needles, and the needle number/inch of the transfer needles being smaller by at least a factor of 2 than the needle number/inch of the latch needles of the first needle carrier; and said perforated structure being formed from loop accumulations generated by the transfer needles and having at least two tuck loops per hole being transferred from the transfer needles onto the latch needles with or without at least one stitch.

12. The functional textile according to claim 11, wherein said perforated structure is configured to locally increase a vapor permeability of the functional textile.

13. The functional textile according to claim 11, which further comprises:

a face of said knitwear;

a right fabric side and a left fabric side of the functional textile;

said perforated structure disposed at least on said right fabric side of the functional textile; and knops formed by using said loop accumulations and projecting out of said face of said knitwear on said left fabric side of the functional textile.

14. The functional textile according to claim 11, which further comprises at least one weft thread worked into said knitwear.

15. The functional textile according to claim 13, wherein at least one of sizes or spacings of at least one of said holes of said perforated structure or of said knops are formed as a function of local requirements of the functional textile with regard to at least one of its capacity for an exchange of at least one of gas, heat or water vapor or its elasticity.

* * * * *